US012303801B2

(12) United States Patent
Forte

(10) Patent No.: US 12,303,801 B2
(45) Date of Patent: May 20, 2025

(54) TRANSFORMABLE SPHERICAL BALL TOY

(71) Applicant: Timothy Forte, Saint Clairsville, OH (US)

(72) Inventor: Timothy Forte, Saint Clairsville, OH (US)

( * ) Notice: Subject to any disclaimer, the term of this patent is extended or adjusted under 35 U.S.C. 154(b) by 207 days.

(21) Appl. No.: 18/064,339

(22) Filed: Dec. 12, 2022

(65) Prior Publication Data

US 2023/0264111 A1 Aug. 24, 2023

Related U.S. Application Data

(60) Provisional application No. 63/313,446, filed on Feb. 24, 2022.

(51) Int. Cl.
*A63H 33/18* (2006.01)
*A63H 33/00* (2006.01)

(52) U.S. Cl.
CPC ..... *A63H 33/004* (2013.01); *A63H 33/18* (2013.01)

(58) Field of Classification Search
CPC ..... A63H 33/003–004; A63H 33/18
See application file for complete search history.

(56) References Cited

U.S. PATENT DOCUMENTS 2,796,697 A * 6/1957 Beyrodt ..... A63H 33/20 446/51
3,147,979 A * 9/1964 Wolfe ..... A63B 43/00 D21/708
3,233,360 A * 2/1966 Poplin ..... A63H 33/20 446/51
3,885,345 A * 5/1975 O'Neill ..... A63H 33/20 446/51
3,889,950 A * 6/1975 Kasravi ..... A63H 33/18 383/117
3,918,663 A * 11/1975 Cornelison, Jr. ..... A63H 27/08 244/153 R
3,949,520 A * 4/1976 Lebensfeld ..... A63H 33/20 446/51
3,954,236 A * 5/1976 Brown ..... A63H 27/082 416/85
4,120,100 A * 10/1978 Dugan ..... B42D 1/003 40/539
4,212,460 A * 7/1980 Kraft ..... A63B 65/00 473/577

(Continued)

*Primary Examiner* — Eugene L Kim
*Assistant Examiner* — Matthew B Stanczak
(74) *Attorney, Agent, or Firm* — Brennan, Manna & Diamond, LLC

(57) ABSTRACT

The present invention relates to a generally spherical toy ball constructed to unfold to a unique shape upon impact with a rigid surface. The ball includes an exterior generally spherical structure having a plurality of flexible fiberglass rods disposed therein with each rod covered by a pliable plastic. Each rod has interlocking ends configured to releasably attach to form the generally spherical shape. The interlocking ends are released during impact as a result of the force imposed when the ball hits a floor or any other rigid surface to transform into the unique shape. The flexible fiberglass rods are designed to enable the ball to attain a second shape such as a parachute, kite, plane, and the like upon unfolding. The toy is reconfigured to fold to the spherical shape (i.e., first shape) upon locking the interlocking ends together.

19 Claims, 5 Drawing Sheets

(56) References Cited

U.S. PATENT DOCUMENTS 4,241,533 A * 12/1980 Newsome ..... A63H 33/18 D21/443
4,271,645 A * 6/1981 Crooks ..... A63H 33/04 52/309.4
4,357,020 A * 11/1982 Van Bryant, Jr. ..... A42B 1/006 473/588
4,543,072 A * 9/1985 Migowski ..... A63H 33/20 446/54
4,709,928 A * 12/1987 Willingham ..... A63F 9/0402 D21/443
4,715,564 A * 12/1987 Kinn ..... A63H 27/08 446/30
4,878,636 A * 11/1989 Mileti ..... A63H 27/08 244/155 A
5,090,935 A * 2/1992 Monson ..... A63F 9/12 446/101
5,123,869 A * 6/1992 Schipmann ..... A63H 33/18 446/225
5,310,378 A * 5/1994 Shannon ..... A63H 33/004 446/72
5,358,440 A * 10/1994 Zheng ..... A63H 33/18 446/487
5,439,017 A * 8/1995 Brown ..... E04H 15/40 135/132
5,564,454 A * 10/1996 Curley ..... E04H 15/40 135/126
5,642,750 A * 7/1997 Brown ..... E04H 15/20 135/156
5,797,815 A * 8/1998 Goldman ..... A63H 33/18 473/588
5,816,954 A * 10/1998 Zheng ..... A63B 9/00 273/400
5,901,926 A * 5/1999 Zheng ..... A63H 27/08 446/61
5,975,983 A * 11/1999 Panec ..... A63H 33/30 141/114
6,045,093 A * 4/2000 Zheng ..... A63H 27/08 244/153 R
6,135,388 A * 10/2000 Hostetter ..... A63H 27/08 446/34
6,267,128 B1 * 7/2001 Zheng ..... E04H 15/40 135/117
6,357,510 B1 * 3/2002 Zheng ..... E04H 15/006 160/354
6,431,942 B1 * 8/2002 Krull ..... A63H 33/00 446/373
6,520,825 B1 * 2/2003 Herr ..... A63H 33/18 446/73
6,565,404 B2 * 5/2003 Oblack ..... A63H 33/18 446/46
6,805,077 B2 * 10/2004 Goldman ..... A01K 15/025 119/707
6,863,588 B1 * 3/2005 Chu ..... A63H 33/18 473/588
6,896,577 B1 * 5/2005 Feng ..... A63H 33/18 446/92
7,690,220 B2 * 4/2010 Okamura ..... A44C 5/2071 63/3.1
7,785,168 B2 * 8/2010 Yamada ..... A63H 3/003 446/99
7,854,688 B2 * 12/2010 Zheng ..... A63B 63/00 190/107
D631,213 S * 1/2011 Morton ..... D30/160
7,914,405 B1 * 3/2011 Scheffler ..... A01K 15/025 473/577
D816,278 S * 4/2018 Keil ..... D30/129
10,378,850 B1 * 8/2019 Young ..... A63H 33/18
10,391,365 B1 * 8/2019 Stillinger ..... A63B 43/002
11,358,072 B2 * 6/2022 Greenwood ..... A63H 23/12
11,426,674 B2 * 8/2022 Mowbray ..... A63H 33/003
11,786,835 B1 * 10/2023 Xiong ..... A63B 39/08 446/267
2003/0016443 A1 * 1/2003 Shin ..... A63H 33/003 359/407
2003/0232565 A1 * 12/2003 Silverglate ..... A63H 33/18 446/34
2006/0009115 A1 * 1/2006 Saucier ..... A63H 33/003 446/268
2007/0004309 A1 * 1/2007 Hinnen ..... A63B 65/10 446/34
2008/0209785 A1 * 9/2008 Jedlicka ..... G09F 15/0062 40/610
2009/0025265 A1 * 1/2009 Jedlicka ..... G09F 19/22 40/610
2009/0156092 A1 * 6/2009 Zawitz ..... A63B 43/06 446/438
2010/0009593 A1 * 1/2010 Hotti ..... A63H 33/101 446/127
2010/0024234 A1 * 2/2010 Taylor ..... G01B 3/1003 33/757
2010/0136873 A1 * 6/2010 Hollis ..... A63H 27/007 446/62
2011/0023926 A1 * 2/2011 Bony ..... E04H 15/40 135/143
2014/0349791 A1 * 11/2014 Schiller ..... A63B 39/00 473/595
2016/0346627 A1 * 12/2016 Le ..... B29D 22/04
2016/0346628 A1 * 12/2016 Tiefel ..... A63H 33/003
2020/0094157 A1 * 3/2020 Choi ..... A63H 33/003
2021/0387105 A1 * 12/2021 Greenwood ..... A63H 23/12
2022/0047958 A1 * 2/2022 Zongker ..... A63H 33/18
2023/0149826 A1 * 5/2023 Zheng ..... A63H 33/00 446/487
2023/0264111 A1 * 8/2023 Forte ..... A63H 33/004 446/4
2024/0342625 A1 * 10/2024 Burke ..... A63H 33/18

* cited by examiner

TRANSFORMABLE SPHERICAL BALL TOY

CROSS-REFERENCE TO RELATED APPLICATION

The present application claims priority to, and the benefit of, U.S. Provisional Application No. 63/313,446, which was filed on Feb. 24, 2022, and is incorporated herein by reference in its entirety.

FIELD OF THE INVENTION

The present invention relates generally to the field of children toys. More specifically, the present invention relates to a novel transformable toy ball configured to transform from a spherical configuration to a unique toy configuration upon being impacted or thrown on or at a rigid surface such as a floor or a wall. The ball has flexible fiberglass rods enabling the ball to change into planes, gliders, helicopters, parachutes, and more, gliding to a landing after being hit or thrown. The transformable toy can be folded back to the original spherical configuration. Accordingly, the present disclosure makes specific reference thereto. Nonetheless, it is to be appreciated that aspects of the present invention are also equally applicable to other like applications, devices, and methods of manufacture.

BACKGROUND

By way of background, children enjoy different types of both indoor and outdoor games. Children are restless and keeping them engaged is quite a task and games help them to remain entertained, joyful, and engaged. There exists a plurality of arcade games, video games, outdoor games, and more played by children. Various research shows that playing games can improve children's abilities to plan, organize, get along with others, and regulate emotions. In addition, play helps with language, math, and social skills, and even helps children cope with stress.

A lot of children like playing a ball game such as a baseball, basketball, or any other type of ball game. A child can play such a game alone or with other children by forming teams. However, a common thing with all types of conventional indoor and outdoor games is that children get bored easily. Kids may lose interest in baseball, basketball, and other types of games. This results in purchasing of multiple game equipment by parents, which is not only expensive but such games require large space for storage. Parents desire a ball game or toy that entertains and engages children for extended periods of time.

Many indoor games such as video games or arcade games require children to sit and play. This leads to less physical activity making kids lazy and lethargic. Also, when kids try to play games with conventional basketballs, baseballs, and more, they end up breaking things in and around the house. Both kids and parents want a more entertaining and unique ball to play with both inside and outside the home, which is also safe for the players and the surroundings.

Therefore, there exists a long-felt need in the art for an improved transformable ball that keeps children entertained and engaged. There is also a long-felt need in the art for an improved transformable ball that can be used by kids for playing both indoors and outdoors. Additionally, there is a long-felt need in the art for an improved transformable ball that improves fun and entertainment for kids who enjoy conventional ball games. Moreover, there is a long-felt need in the art for an improved transformable ball that is reusable and attains a unique shape upon impact with a surface. Further, there is a long-felt need in the art for an improved transformable ball that can be used for playing alone or with other kids. Finally, there is a long-felt need in the art for an improved playing ball for kids that enables children to chase the ball after throwing or hitting, close it back up, and repeat the process for endless fun and entertainment.

The subject matter disclosed and claimed herein, in one embodiment thereof, comprises a toy ball repeatedly reconfigurable between a spherical shape configuration and an unfolded unique toy shape configuration. The toy ball further comprising a soft and flexible exterior structure configured to provide a spherical shape to the toy ball, a plurality of flexible fiberglass rods covered by a pliable plastic, the flexible fiberglass rods are integrated to the exterior structure, each fiberglass rod has interlocking ends configured to releasably latch to each other for folding the toy ball upon being fastened together and unfolding the toy ball upon being unfastened, wherein the flexible fiberglass rods are expanded and the interlocking ends are released when the toy ball is nondestructively thrown on a floor for unfolding the toy ball from the generally spherical ball configuration to the unfolded toy shape configuration.

In this manner, the pliable toy ball of the present invention accomplishes all of the forgoing objectives and provides kids with an improved transformable ball designed to unfold and change shape when hit or thrown. The ball unfolds into at least one of a plane, a glider, a helicopter, a parachute, and more for endless fun and entertainment. The ball enables children to chase the ball after throwing or hitting, close it back up, and repeat the process. The ball can be used by children of all ages and can be used both indoors and outdoors.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a toy ball repeatedly reconfigurable between a spherical ball configuration and an unfolded toy shape configuration. The toy ball further comprising an exterior structure configured to provide a spherical shape to the toy ball, a first flexible fiberglass rod covered by a pliable plastic, a second flexible fiberglass rod covered by another pliable plastic, the first flexible fiberglass rod and the second flexible fiberglass rod are integrated transversally in the exterior structure, each fiberglass rod has interlocking ends configured to releasably latch to each other for folding the toy ball upon being fastened together and unfolding the toy ball upon being unfastened, wherein the flexible fiberglass rods are expanded and the interlocking ends are released when the toy ball is nondestructively thrown on a floor for unfolding the toy ball from the generally spherical ball configuration to the unfolded toy shape configuration. The interlocking ends can be mechanically or magnetically connected and can be attached or fastened together to reconfigure the toy ball to the spherical ball configuration.

In one embodiment of the present invention, the unfolded toy shape configuration is at least one of a kite, a parachute, and a plane.

In one embodiment of the present invention, the exterior structure is formed of ripstop nylon fabric and has integrated flexible fiberglass rods therein.

In one embodiment of the present invention, the flexible fiberglass rods are positioned linearly in the exterior structure.

The subject matter disclosed and claimed herein, in one embodiment thereof, comprises an expandable toy nondestructively and repeatably reconfigurable between a spherical configuration and an unfolded configuration, the toy further comprising a plurality of flexible fiberglass rods integrated on the exterior spherical structure, each fiberglass rod has interlocking opposite ends that are releasably attached to each other for maintaining the exterior spherical structure, the spherical structure has a ripstop nylon cover for flexibility, the interlocking opposite ends are configured to release when the toy in spherical configuration hits a floor or any surface to unfold the toy and attain the expandable toy shape.

In yet another embodiment, the fly ball toy of the present invention is easily and efficiently manufactured, marketed, and available to consumers in cost-effective manner and is easily installed and used by users.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
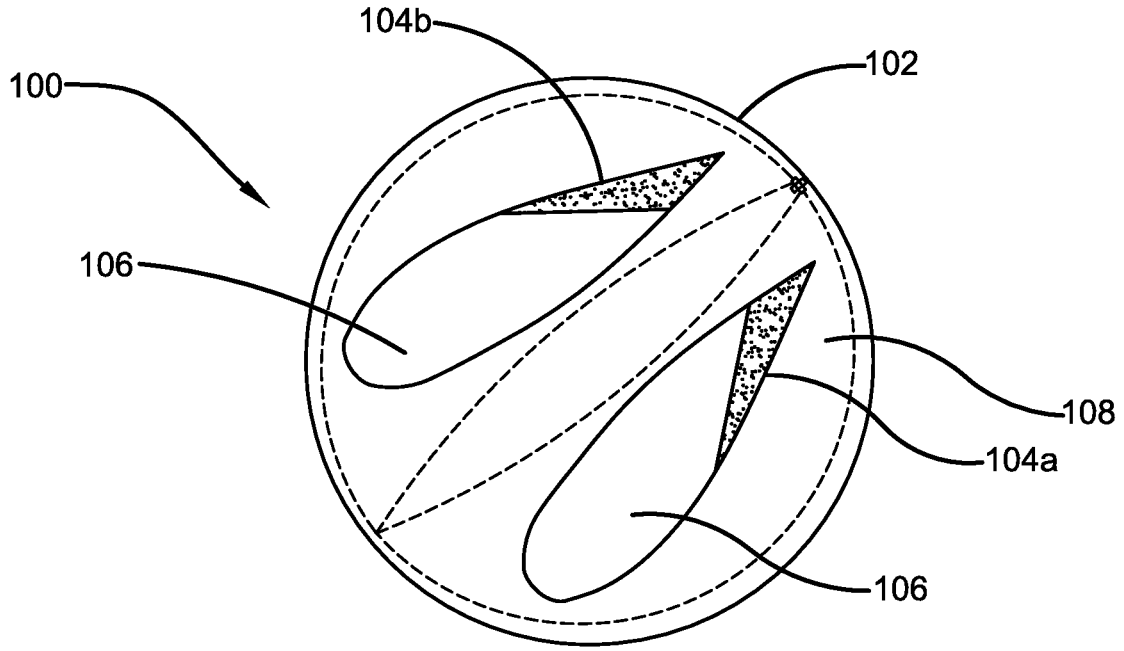
FIG. 1 illustrates a plan view of one potential embodiment of a fly toy ball in folded state in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved transformable ball that keeps children entertained and engaged. There is also a long-felt need in the art for an improved transformable ball that can be used by kids for playing both indoors and outdoors. Additionally, there is a long-felt need in the art for an improved transformable ball that improves fun and entertainment for kids who enjoy conventional ball games. Moreover, there is a long-felt need in the art for an improved transformable ball that is reusable and attains a unique shape upon impact with a surface. Further, there is a long-felt need in the art for an improved transformable ball that can be used for playing alone or with other kids. Finally, there is a long-felt need in the art for an improved playing ball for kids that enables children to chase the ball after throwing or hitting, close it back up, and repeat the process for endless fun and entertainment.

The present invention, in one exemplary embodiment, is an expandable toy nondestructively and repeatably reconfigurable between a spherical configuration and an unfolded configuration. The unfolded configuration can be of any shape other than the spherical configuration and the toy further comprising at least two flexible fiberglass rods integrated to the exterior spherical structure, each fiberglass rod having interlocking opposite ends that are releasably attached to each other for maintaining the exterior spherical structure, the spherical structure has a ripstop nylon cover for flexibility, the interlocking opposite ends are configured to release when the toy in an initial spherical configuration hits a floor or any surface to unfold the toy and attain the expandable toy shape.

Figure 2:
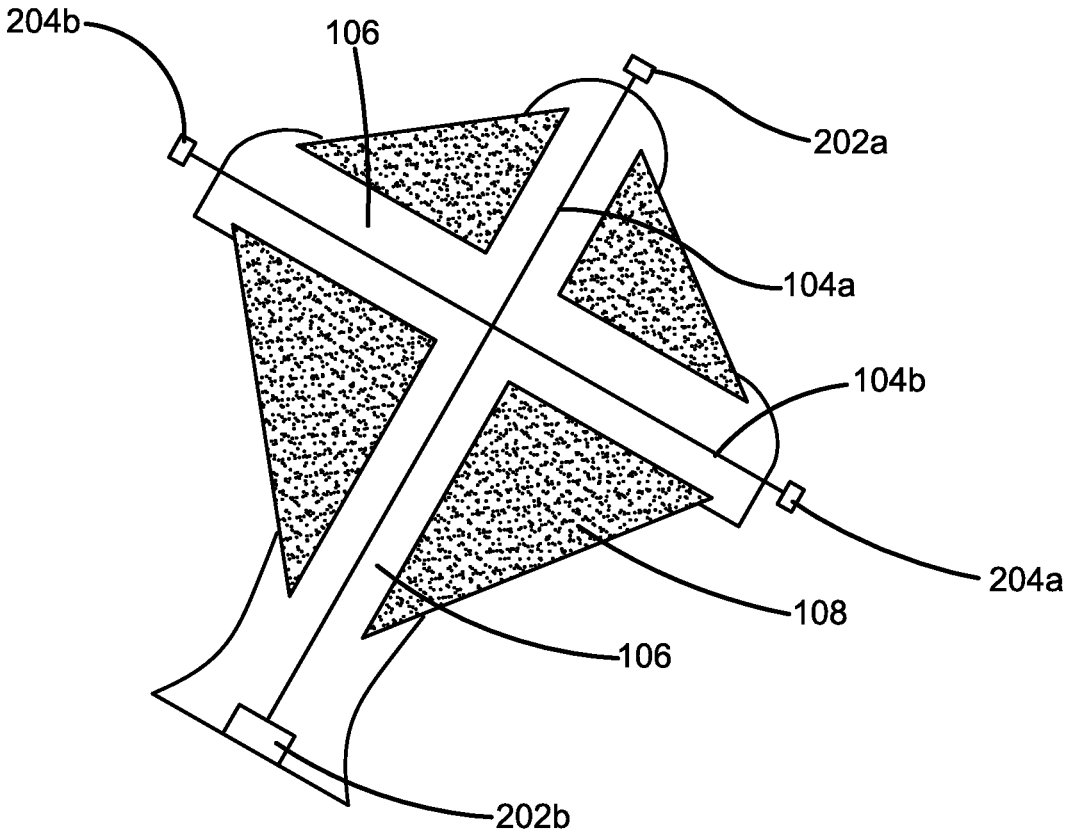
FIG. 2 illustrates a perspective view showing the fly toy ball in an unfolded state and transformed into a kite in accordance with the disclosed architecture.

Referring initially to the drawings, FIG. 1 illustrates a plan view of one potential embodiment of the toy ball in a folded state (i.e., a first shape) in accordance with the disclosed architecture. The toy ball 100 is designed as a lightweight, soft, and pliable ball made from a plastic material and configured to unfold and transform its shape when thrown or impacted on or at a rigid surface. The ball 100 in a folded state (i.e., a first shape) is generally spherical and appears like a conventional ball such as a basketball, a baseball, or the like and transforms into a unique second shape such as a kite, a parachute, a plane, and many more. The toy ball 100 includes an exterior structure 102 which provides an overall spherical shape to the ball 100. The exterior surface 102 has a plurality of flexible fiberglass rods 104*a*, 104*b* forming a portion of the exterior surface 102, the fiberglass rods 104*a*, 104*b* are configured to be covered by soft pliable plastic 106. Each fiberglass rod has interlocked opposite or opposing ends as illustrated in FIG. 2 in the spherical ball 100 in an unfolded state. The interlocked ends are configured to interlock and are released or unlocked upon an impact such as when the ball 100 is thrown on or at a rigid surface, thereby enabling the ball 100 to unfold to a unique shape.

The exterior structure 102 is made from ripstop nylon fabric 108 which is tear resistant and weatherproof. In construction, the fiberglass rods 104*a*, 104*b* and the soft pliable plastic 106 are sewn or integrated across the nylon material exterior structure 102. The fiberglass rods 104*a*, 104*b* are designed and positioned on the exterior structure 102 such that when the ball 100 is unfolded, a unique shape formed by the fiberglass rods 104*a*, 104*b* and the nylon material is formed as illustrated and described later in the disclosure.

It should be noted that the fiberglass rods 104*a*, 104*b* and the interlocking opposite ends do not protrude from the exterior structure 102 of the foldable toy ball 100. The fiberglass rods 104*a*, 104*b* are flexible and are positioned transverse to each other for enabling the ball 100 to completely unfold when the ball 100 hits a floor or any surface.

FIG. 2 illustrates a perspective view showing the fly toy ball 100 in an unfolded state and transformed into a kite in accordance with the disclosed architecture. The ball 100 when thrown on a floor or surface is unfolded due to the force impacted on the interlocked ends 202*a*, 202*b* and 204*a*, 204*b*, respectively. The interlocked ends 202*a*, 202*b* are interlocked and form a part of the fiberglass rod 104*a* such that the ends 202*a*, 202*b* are automatically unfastened and released or unlocked when the ball 100 is thrown or impacted. Similarly, the interlocking ends 204*a*, 204*b* of the fiberglass rod 104*b* are unfastened to completely unfold the exterior surface 102 of the ball 100 to attain, for example, the kite shape.

It should be noted that based on the folding configuration of the fiberglass rods 104*a*, 104*b*, any unique shape can be formed upon unfolding of the fly ball 100 upon impact. In all the embodiments of the present invention, the fiberglass rods are flexible, soft, and can bend without breaking to help attain the spherical shape of the exterior structure 102. The interlocking ends forms pressure or force responsive releasable latch that are released or unlocked on force or pressure of an impact. The interlocking ends can be fastened together again without any mechanical device or screw by just pressing the ends 202*a*, 202*b* against each other. Similarly, the interlocking ends 204*a*, 204*b* can be pressed against each other to fasten the ends of the rod 104*b*.

Figure 3:
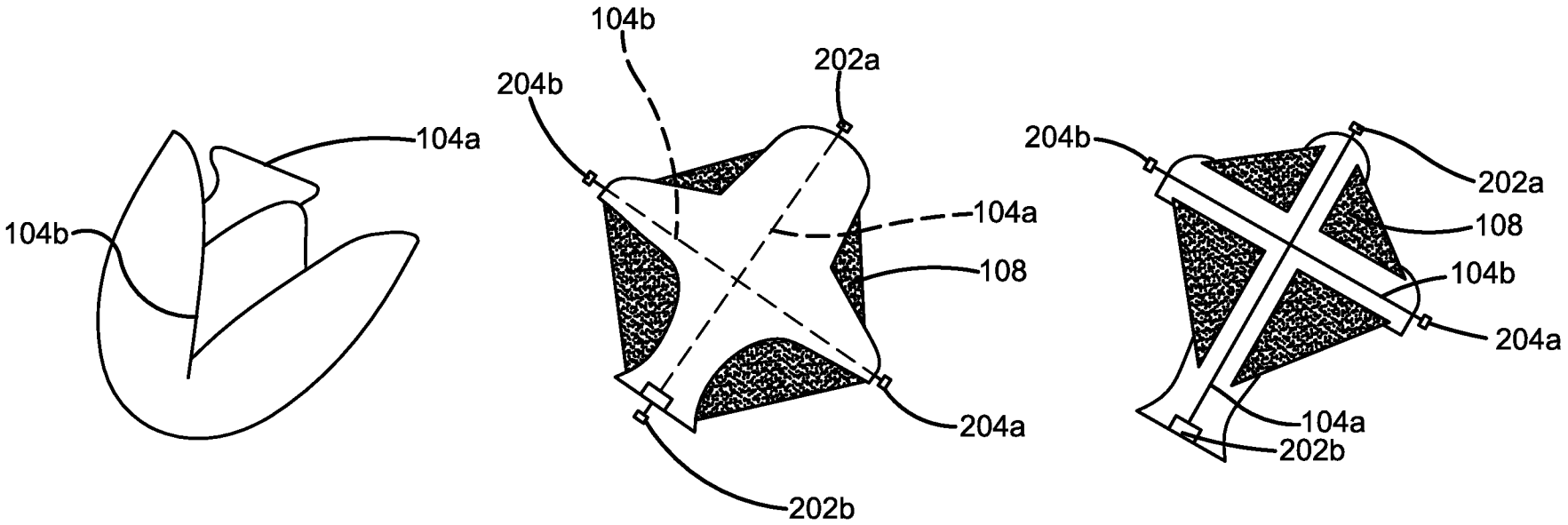
FIG. 3 illustrates a perspective view showing the transition from the generally spherical folded state to the unfolded or expanded kite shape of the fly ball in accordance with the disclosed architecture.

FIG. 3 illustrates a perspective view showing the transition from the generally spherical folded state to unfolded or expanded kite shape of the fly ball 100 in accordance with the disclosed architecture. As illustrated, the ball 100 starts to unfold when impacted on a floor such as when thrown by a kid. During unfolding, the latches formed by the interlocking ends 202*a*, 202*b* and 204*a*, 204*b*, respectively, are unfastened, unlocked, or released causing the fiberglass rods 104*a*, 104*b* to expand and straighten. The rods 104*a*, 104*b* expand and straighten with the ripstop nylon fabric attached to the pliable plastic 106 forming a flat structure of the ball 100.

The fiberglass rods 104*a*, 104*b* are invisible to a user and opaquely covered by the pliable plastic 106 such that, for example, the kite shape of the unfolded ball is clear and allows a kid to remain engaged and entertained for extended periods of time. For throwing or gliding the ball 100, the ball 100 can be easily folded again by a kid by folding the fiberglass rods 104*a*, 104*b* and latching the interlocking ends 202*a*, 202*b* together and the interlocking ends 204*a*, 204*b* together. It is to be appreciated that the interlocking ends 202*a*, 202*b* are frictionally press fit together when the ball 100 is in the first shape. Similarly, interlocking ends 204*a*, 204*b* are frictionally press fit together when the ball 100 is in the first shape.

Figure 4:
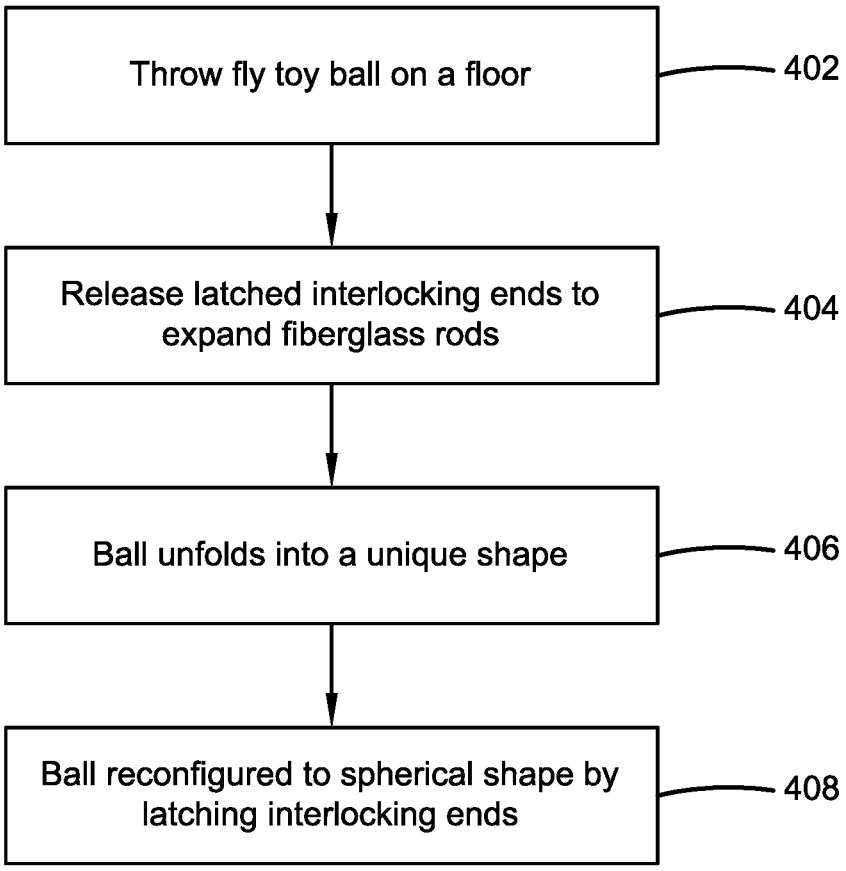
FIG. 4 illustrates a flow diagram depicting a process of using the fly toy ball of different embodiments of the present invention in accordance with the disclosed architecture.

FIG. 4 illustrates a flow diagram depicting a process of using fly toy ball of different embodiments of the present invention in accordance with the disclosed architecture. Initially, the ball is in a folded configuration in a spherical shape and is then thrown by a kid onto a surface such as a floor (Step 402). Based on the impact on the interlocking ends, the latched interlocking ends of the fiberglass rods are released or unlocked and the fiberglass rods are expanded and elongated (Step 404).

The elongated fiberglass rods along with the nylon cover flattens and unfolds the ball from the generally spherical configuration to a unique shape such as a kite, a parachute, a plane, and more, based on the design and shape of the fiberglass rods (Step 406). Finally, for using the toy again as a ball, the toy is folded by latching the interlocking ends to reconfigure the toy into spherical shape (Step 408).

It should be noted that the toy 100 does not unfold when thrown on a person or on a soft surface. Further, the toy 100 is weatherproof and tear resistant, and therefore can be used both indoors and outdoors. The exterior structure 102 can be of any color and may have any design, logo, or other indicia to meet requirements and preferences of different kids. The toy 100 is soft and flexible and therefore, does not cause any injury to children.

Figure 5:
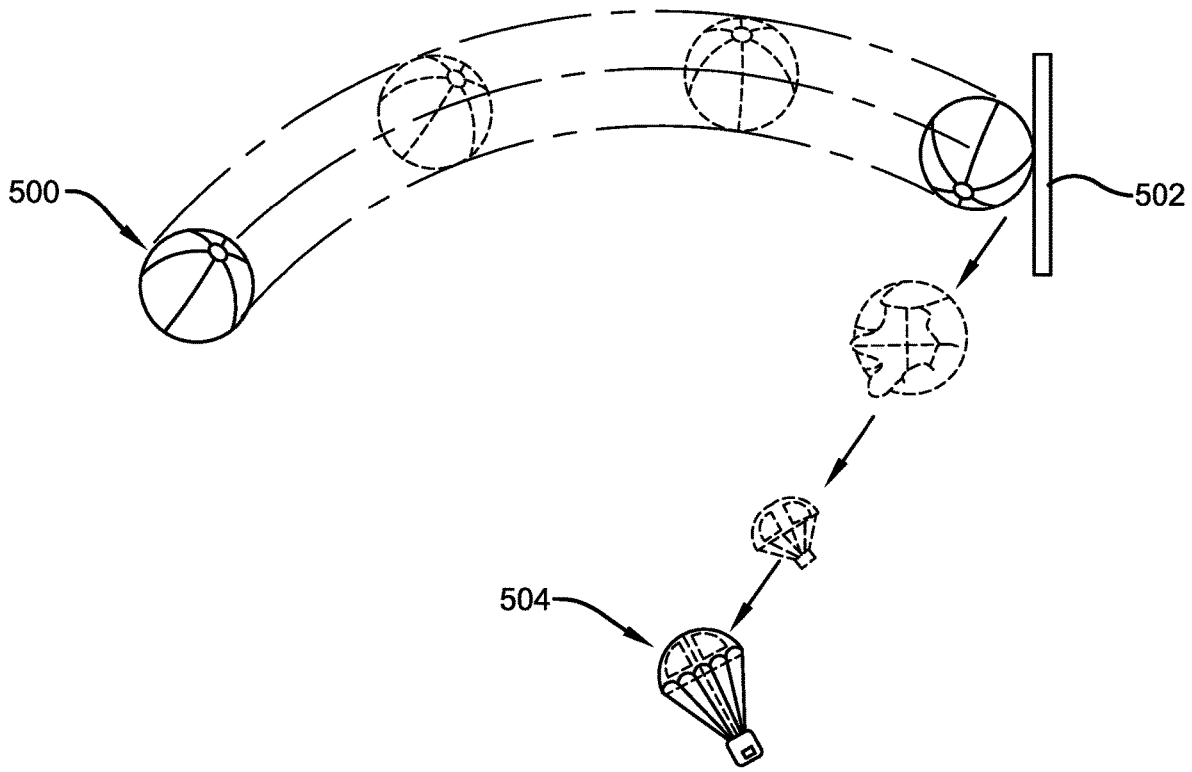
FIG. 5 illustrates a perspective view showing the transition of another embodiment of the fly toy ball of the present invention into a parachute after being thrown on a wall in accordance with the disclosed architecture.

FIG. 5 illustrates a perspective view showing the transition of another embodiment of the toy ball of the present invention into a parachute after being thrown on a wall in accordance with the disclosed architecture. As illustrated, in the present embodiment, the toy ball 500 initially being in spherical shape is thrown at a wall 502 can be transformed, for example, into a parachute 504 in unfolded state. The flexible fiberglass rods in the ball 500 have interlocking ends as discussed in earlier embodiments of the present invention such that the interlocking ends are released or unlocked to unfold the ball 500 and convert into the parachute 504. It should be appreciated that there is no limit to the shapes that the toy ball of different embodiments of the present invention can attain upon unfolding. Further, the toy is reconfigured to spherical shape upon fastening the interlocking ends.

A force or impact exerted onto the ball is required to transform the ball into a unique shape and further, because the mechanism for transforming the toy ball from the generally spherical shape (i.e., the first shape) to the second shape is relatively simple, the realization of the miniaturization of the toy is also potentiated. Hereby, the toy can be used for playing by kids of all ages.

The unfolded shape can be selected from the group consisting of triangular prisms, egg shapes, animal shapes, planet shapes, robot shapes, vehicle shapes, building shapes, tree shapes, sports equipment related shapes, weapons shapes, character-head shapes, and the like. Although the embodiments disclose a "spherical shape", however, other rollable shapes such as a rugby ball shape or a circular shape for example can also be employed.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "fly toy ball", "toy ball", "foldable toy ball", "ball", and improved toy ball" are interchangeable and refer to the transformable toy ball 100, 500 of the present invention.

Notwithstanding the forgoing, the transformable toy ball 100, 500 of the present invention can be of any suitable size and configuration as is known in the art without affecting the overall concept of the invention, provided that it accomplishes the above-stated objectives. One of ordinary skill in the art will appreciate that the transformable toy ball 100, 500 as shown in the FIGS. are for illustrative purposes only, and that many other sizes and shapes of the transformable toy ball 100, 500 are well within the scope of the present disclosure. Although the dimensions of the transformable toy ball 100, 500 are important design parameters for user convenience, the transformable toy ball 100, 500 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A ball transformable to a toy comprising:

a toy ball having an outer surface comprising a pliable plastic, a fabric, and a plurality of flexible rods;

wherein said toy ball configured to unfold and transform from a spherical first shape to another second shape;

wherein said toy ball is transformed from said first shape to said second shape upon impact of said toy ball on a rigid surface;

wherein said plurality of flexible rods at least partially covered by said pliable plastic; and further wherein each of said plurality of flexible rods having interlocked opposing ends when said toy ball is in said first shape and having unlocked said opposing ends when said toy ball is in said second shape.

2. The ball transformable to a toy of claim 1, wherein said plurality of flexible rods is a pair of flexible rods.

3. The ball transformable to a toy of claim 2, wherein said fabric is a tear resistant ripstop nylon fabric.

4. The ball transformable to a toy of claim 3, wherein said pair of flexible rods are fiberglass rods.

5. The ball transformable to a toy of claim 4, wherein said pair of flexible rods are sewn to said pliable plastic.

6. The ball transformable to a toy of claim 5, wherein said pair of flexible rods are transverse to each other when said toy ball is in said second shape.

7. The ball transformable to a toy of claim 6, wherein said pair of flexible rods expand and straighten with said ripstop nylon fabric attached to said pliable plastic forming a generally flat structure of said second shape of said toy ball.

8. The ball transformable to a toy of claim 7, wherein said first shape is a basketball shape.

9. The ball transformable to a toy of claim 8, wherein said second shape is selected from a group consisting of a kite shape and a parachute shape.

10. The ball transformable to a toy of claim 1, wherein said interlocked opposing ends are frictionally press fit together when said toy ball is in said first shape.

11. A ball transformable to a toy comprising:

a toy ball having an outer surface comprising a pliable plastic, a fabric, and a plurality of flexible rods;

wherein said toy ball configured to unfold and transform from a spherical first shape to another second shape;

wherein said toy ball is transformed from said first shape to said second shape upon impact of said toy ball on a rigid surface;

wherein each of said plurality of flexible rods having interlocked opposing ends when said toy ball is in said first shape and having unlocked said opposing ends when said toy ball is in said second shape; and further wherein said interlocked opposing ends are frictionally press fit together when said toy ball is in said first shape.

12. The ball transformable to a toy of claim 11, wherein said plurality of flexible rods is a pair of flexible rods.

13. The ball transformable to a toy of claim 11, wherein said plurality of flexible rods at least partially covered by said pliable plastic.

14. The ball transformable to a toy of claim 11, wherein said fabric is a tear resistant ripstop nylon fabric.

15. The ball transformable to a toy of claim 11, wherein said plurality of flexible rods are fiberglass rods.

16. The ball transformable to a toy of claim 11, wherein said plurality of flexible rods are sewn to said pliable plastic.

17. The ball transformable to a toy of claim 11, wherein said plurality of flexible rods are transverse to each other when said toy ball is in said second shape.

18. A ball transformable to a toy comprising:

a toy ball having an outer surface comprising a pliable plastic, a fabric, and a plurality of flexible rods;

wherein said toy ball configured to unfold and transform from a spherical first shape to another second shape;

wherein said toy ball is transformed from said first shape to said second shape upon impact of said toy ball on a rigid surface;

wherein each of said plurality of flexible rods having interlocked opposing ends when said toy ball is in said first shape and having unlocked said opposing ends when said toy ball is in said second shape;

wherein said interlocked opposing ends are frictionally press fit together when said toy ball is in said first shape;

wherein said first shape is a basketball shape; and further wherein said second shape is selected from a group consisting of a kite shape and a parachute shape.

19. The ball transformable to a toy of claim 18, wherein said plurality of flexible rods is a pair of flexible rods.

* * * * *